US011116258B2

(12) United States Patent
Cowell

(10) Patent No.: US 11,116,258 B2
(45) Date of Patent: Sep. 14, 2021

(54) TOELESS GARMENT

(71) Applicant: HBI Branded Apparel Enterprises, LLC, Winston Salem, NC (US)

(72) Inventor: William Cowell, Clarksville, AR (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 150 days.

(21) Appl. No.: 16/047,841

(22) Filed: Jul. 27, 2018

(65) Prior Publication Data

US 2019/0029332 A1 Jan. 31, 2019

Related U.S. Application Data

(60) Provisional application No. 62/538,494, filed on Jul. 28, 2017.

(51) Int. Cl.

| | |
|---|---|
| ***A41B 11/08*** | (2006.01) |
| ***A41B 11/00*** | (2006.01) |
| ***D04B 1/10*** | (2006.01) |

(52) U.S. Cl.

CPC ..... *A41B 11/08* (2013.01); *D04B 1/106* (2013.01); *A41B 11/008* (2013.01); *A41D 2300/00* (2013.01)

(58) Field of Classification Search

CPC ..... A41B 11/06; A41B 11/14; A41B 11/08; A41B 11/008; D04B 1/106; D04B 1/26

USPC ..... 2/239

See application file for complete search history.

(56) References Cited

U.S. PATENT DOCUMENTS

| | | | | |
|---|---|---|---|---|
| 1,518,758 A | | 12/1924 | Rodee | |
| 2,424,056 A | | 7/1947 | Ruth | |
| 2,953,003 A | * | 9/1960 | Crawford | D04B 9/54 66/41 |
| 3,064,456 A | * | 11/1962 | Bird | D04B 1/265 66/178 R |
| 3,111,676 A | | 11/1963 | Artzt | |
| 3,392,553 A | * | 7/1968 | Burleson | D04B 1/106 66/172 E |
| 3,453,843 A | * | 7/1969 | Knohl | D04B 1/106 66/185 |
| 3,729,956 A | * | 5/1973 | Nebel | D04B 1/26 66/172 E |
| 3,975,929 A | | 8/1976 | Fregeolle | |

(Continued)

FOREIGN PATENT DOCUMENTS

| | | |
|---|---|---|
| CA | 371773 | 2/1938 |
| CN | 105614965 | 6/2016 |
| WO | WO2004023904 | 3/2004 |

OTHER PUBLICATIONS

International Search Report and Written Opinion in International Application PCT/US2018/0044066, dated Sep. 25, 2018, 18 pages.

(Continued)

*Primary Examiner* — Jillian K Pierorazio

(74) *Attorney, Agent, or Firm* — Fish & Richardson P.C.

(57) ABSTRACT

A garment, such as sheer hosiery or other toeless garment, includes a body portion configured to encircle at least part of a lower leg of a wearer of the garment, and a welt portion adjacent an end of the body portion. The welt portion is configured to encircle a foot of the wearer, and defines an opening for a portion of the foot of the wearer. The welt portion can include a turned welt.

16 Claims, 6 Drawing Sheets

(56) References Cited

U.S. PATENT DOCUMENTS

| | | | | |
|---|---|---|---|---|
| 4,180,065 | A * | 12/1979 | Bowen | A61F 13/08 2/239 |
| 4,181,982 | A | 1/1980 | Segovia | |
| 4,475,253 | A | 10/1984 | Laveckis | |
| 4,756,027 | A | 7/1988 | Buenos | |
| 5,054,129 | A | 10/1991 | Baehr | |
| 5,067,179 | A | 11/1991 | Wormser | |
| 5,097,537 | A | 3/1992 | Ewing | |
| D358,703 | S | 5/1995 | Moffre et al. | |
| 5,412,957 | A | 5/1995 | Bradberry | |
| 5,428,975 | A | 7/1995 | Lee et al. | |
| 5,509,282 | A | 4/1996 | Ferrell, Jr. | |
| 5,553,468 | A | 9/1996 | Osborne | |
| 5,590,548 | A * | 1/1997 | Osborne | A41B 9/04 2/401 |
| 5,749,100 | A | 5/1998 | Rosenberg | |
| 6,047,571 | A | 4/2000 | Juniman | |
| 6,415,448 | B1 | 7/2002 | Glogover | |
| D476,147 | S | 6/2003 | Campbell | |
| D487,842 | S | 3/2004 | Booker, III | |
| 7,007,309 | B1 | 3/2006 | Mende | |
| 7,533,424 | B2 | 5/2009 | Symonds-Powell | |
| D595,049 | S | 6/2009 | Rice | |
| D601,336 | S | 10/2009 | Stewart | |
| 7,669,252 | B2 | 3/2010 | Wei | |
| D674,589 | S | 1/2013 | Macon | |
| 9,828,706 | B2 | 11/2017 | Seawell | |
| 2002/0083511 | A1 | 7/2002 | Glogover | |
| 2005/0177927 | A1 | 8/2005 | Hettich | |
| 2008/0286513 | A1 | 11/2008 | Haigh | |
| 2009/0193567 | A1 | 8/2009 | Treptow | |
| 2009/0265838 | A1 * | 10/2009 | Lee | A41B 11/08 2/409 |
| 2010/0095434 | A1 * | 4/2010 | Stuart | A41B 11/008 2/240 |
| 2010/0107313 | A1 * | 5/2010 | Rad | D04B 1/243 2/409 |
| 2010/0282433 | A1 | 11/2010 | Blackford | |
| 2012/0015155 | A1 | 1/2012 | Blackford | |
| 2014/0128785 | A1 * | 5/2014 | Dickson | A61H 1/008 601/84 |
| 2014/0366237 | A1 | 12/2014 | Boudreau | |
| 2015/0074872 | A1 * | 3/2015 | Seawell | D04B 1/26 2/242 |
| 2016/0081840 | A1 * | 3/2016 | Higgins | A61F 5/00 602/63 |
| 2016/0150832 | A1 | 6/2016 | Solano et al. | |
| 2016/0309800 | A1 | 10/2016 | Boudreau | |

OTHER PUBLICATIONS

International Preliminary Report on Patentability in International Application No. PCT/US2018/044066, dated Jan. 28, 2020, 7 pages.

* cited by examiner

TOELESS GARMENT

CROSS-REFERENCE TO RELATED APPLICATION(S)

This application claims the benefit of priority to U.S. Provisional Application Ser. No. 62/538,494, filed on Jul. 28, 2017, the contents of which are hereby incorporated by reference.

TECHNICAL FIELD

This disclosure relates to toeless garments.

BACKGROUND

Tights, hosiery, and other lower body garments can include an open toe or a closed toe, depending on a desired activity of the wearer or desired function for the garment. Open toe lower body garments often include silicone, toe loops, or bar tacks to hold the open toe portion of the garment in place on a wearer.

SUMMARY

This disclosure describes garments, such as toeless garments, that include a welt portion that encircles a portion of a foot of a wearer.

In some aspects, a garment includes a body portion configured to encircle at least part of a lower leg of a wearer of the garment, and a welt portion adjacent an end of the body portion. The welt portion is configured to encircle a foot of the wearer, and the welt portion defines an opening.

This, and other aspects, can include one or more of the following features. The welt portion can include a turned welt. The garment can be configured such that the welt portion encircles the foot at an arch of the foot. The welt portion can include a silicone band attached to or integral to the welt portion. The welt portion can be free from silicone. The welt portion can include nylon and spandex yarns. The welt portion can be seamlessly knit to the body portion. The welt portion can be sewn to the body portion. The welt portion can include a first yarn having a thickness greater than a second yarn located in the body portion. The thickness of the first yarn of the welt portion can be about three times the thickness of the second yarn located in the body portion. The first yarn can be or include a 70 denier yarn. The welt portion can include an elongation of at least 115%, and the welt portion can be configured to compress the portion of the foot of the wearer when stretched beyond an initial, unstretched length of the welt portion. The garment can include tights, stockings, hosiery, pants, or long underwear. The garment can include sheer hosiery.

Certain aspects of the disclosure encompass a method for encircling a foot of a wearer. The method includes encircling, with a body portion of a garment, at least part of a lower leg of a wearer of the garment, and encircling, with a welt portion of the garment, a portion of a foot of the wearer. The welt portion is connected to the body portion.

This, and other aspects, can include one or more of the following features. The welt portion can include a turned welt encircling the portion of the foot of the wearer. Encircling a portion of a foot of the wearer can include encircling, with the welt portion, an arch area of the foot of the wearer. Encircling a portion of a foot of the wearer can include compressing, with the welt portion, the portion of the foot of the wearer, where the welt portion includes an elongation of at least 115%. Encircling, with the welt portion, the portion of the foot of the wearer can include directly contacting the portion of the foot of the wearer with the welt portion. The welt portion can be free from silicone, and the foot of the wearer does not contact silicone proximate to the welt portion. The method can include moving the welt portion along the foot to a second portion of the foot different from the first-mentioned portion of the foot.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure describes a toeless garment, for example, intended to cover at least part of a foot of a wearer of the garment and at least part of a lower leg of the wearer. The toeless garment includes a body portion and a welt portion, or toe cuff, at an end of the body portion. The welt portion can include a turned welt, which compresses against the foot of the wearer to hold the welt portion in place on the foot of the wearer. The welt portion is adjustable by hand, and can be positioned at any point along the foot of the wearer. For example, the welt portion can be positioned anywhere between the toes and the heel of the foot of the wearer, such as at the ball of the foot, at the arch of the foot, or another location along the foot. The welt portion can exclude silicone or other polymers, toe loops, or bar tacks conventionally used to hold a toe cuff in place. The toeless garment described herein provides a wearer with options to use a variety of shoe types for wardrobe flexibility.

Figure 1:
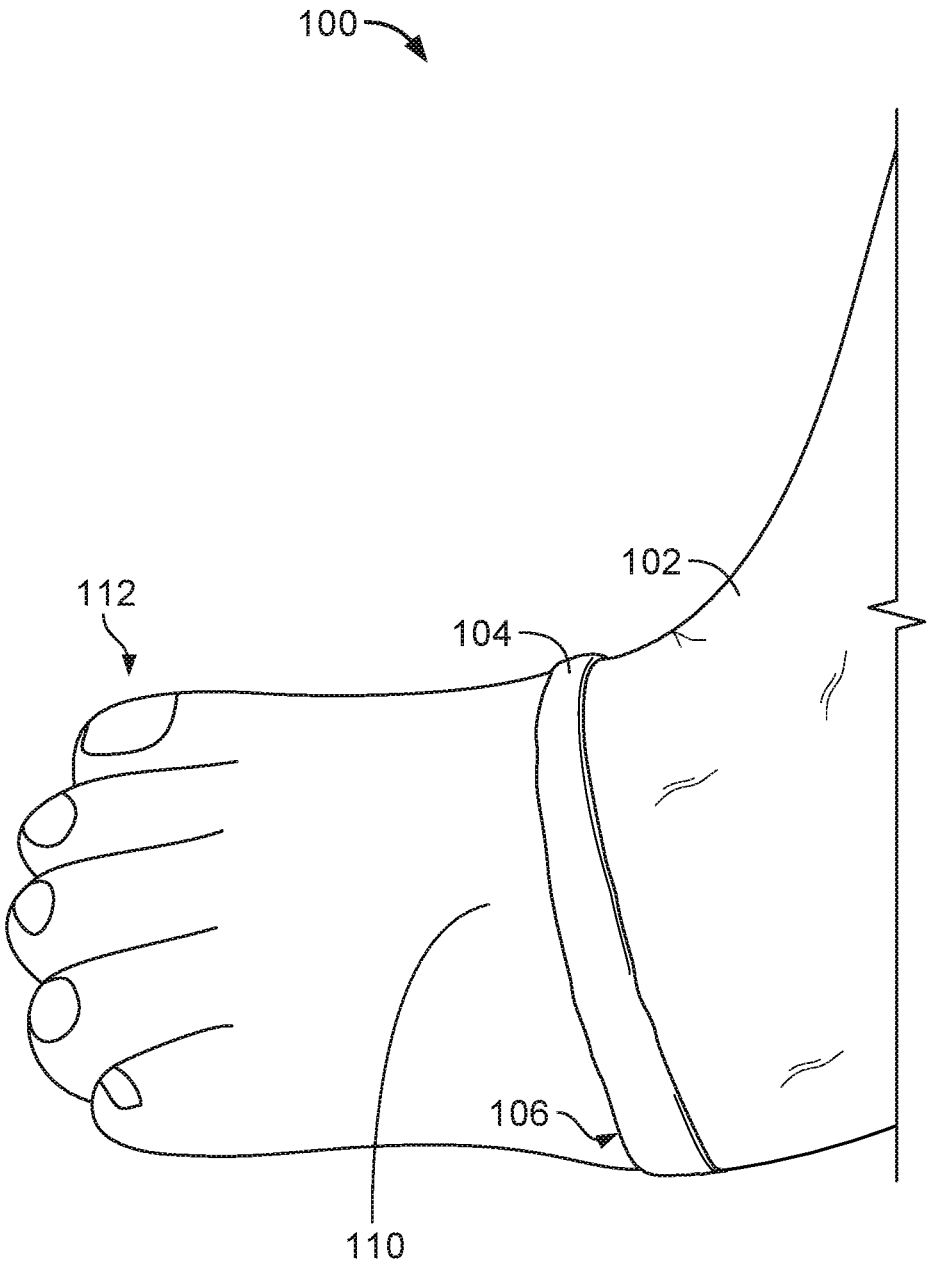
FIG. 1 is a partial side view of an example toeless garment on a foot of a wearer.
Figure 2:
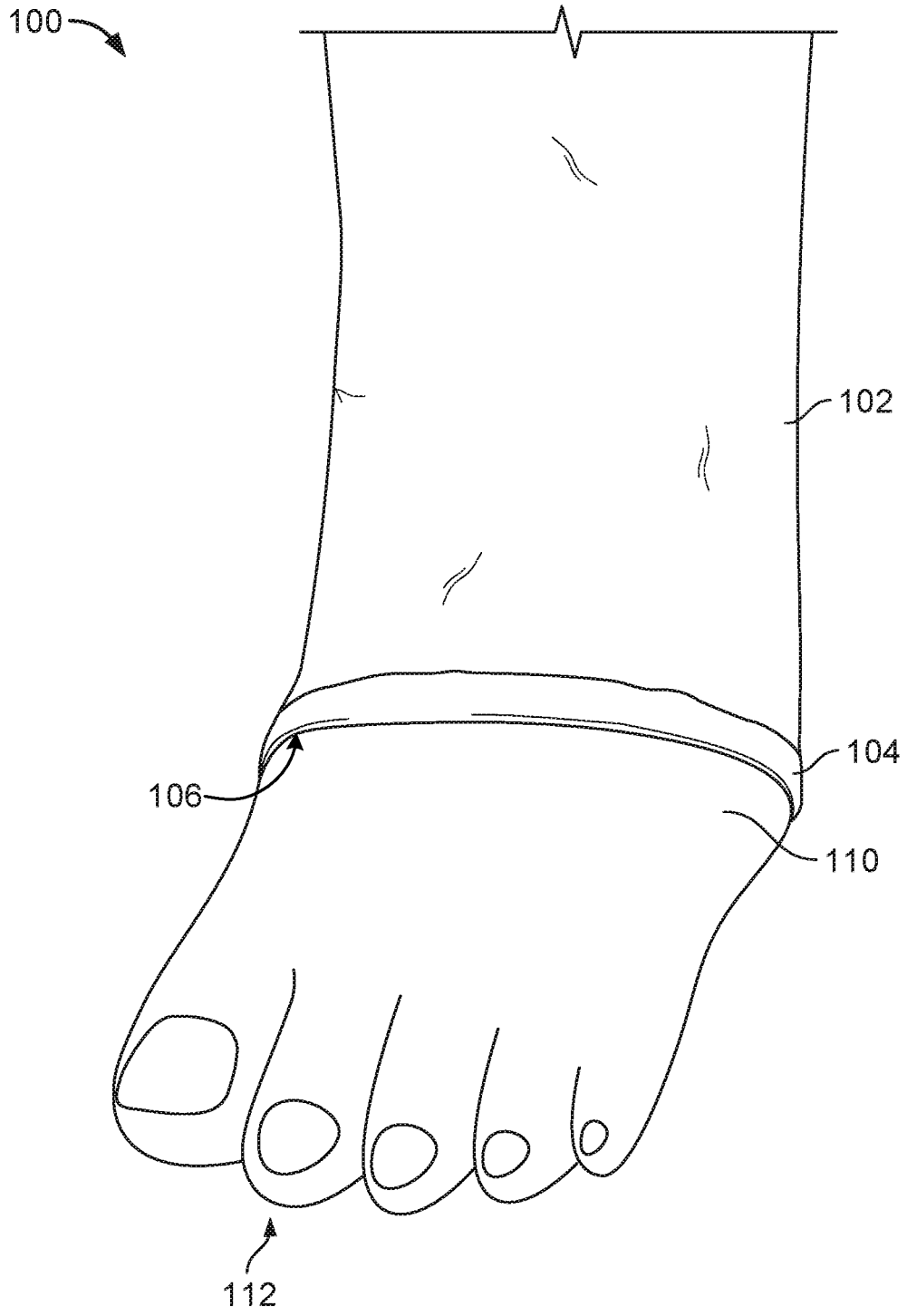
FIG. 2 is a partial front view of an example toeless garment on a foot of a wearer.
Figure 3A:
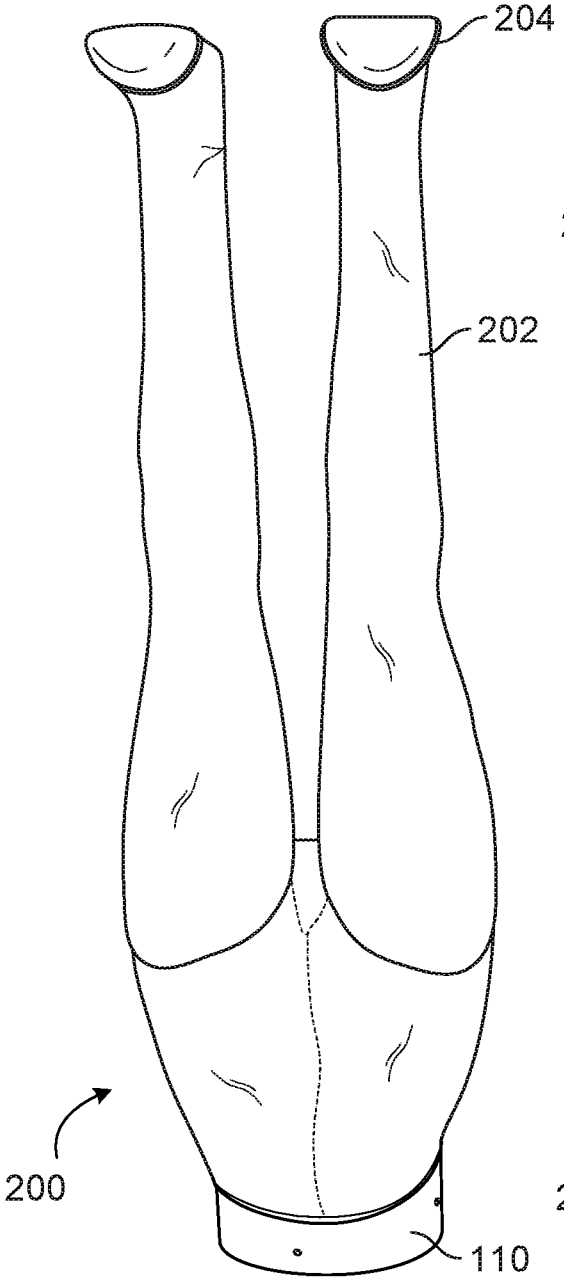
FIGS. 3A-3E are front, perspective, left side, right side, and close-up perspective views, respectively, of an example toeless garment on a wearer.
Figure 3B:
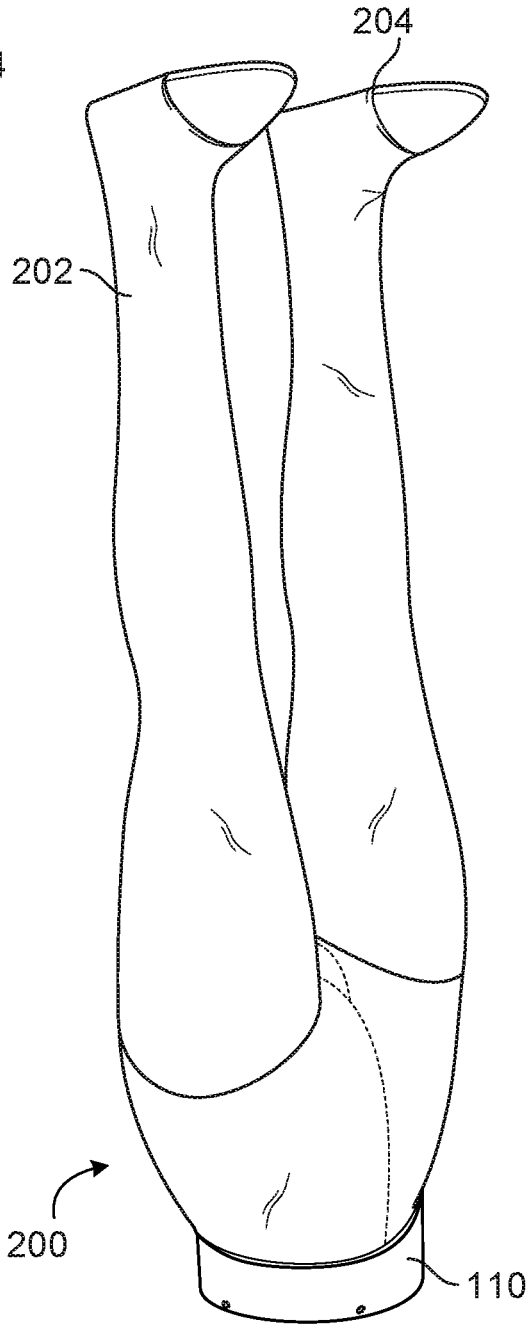
Figure 3C:
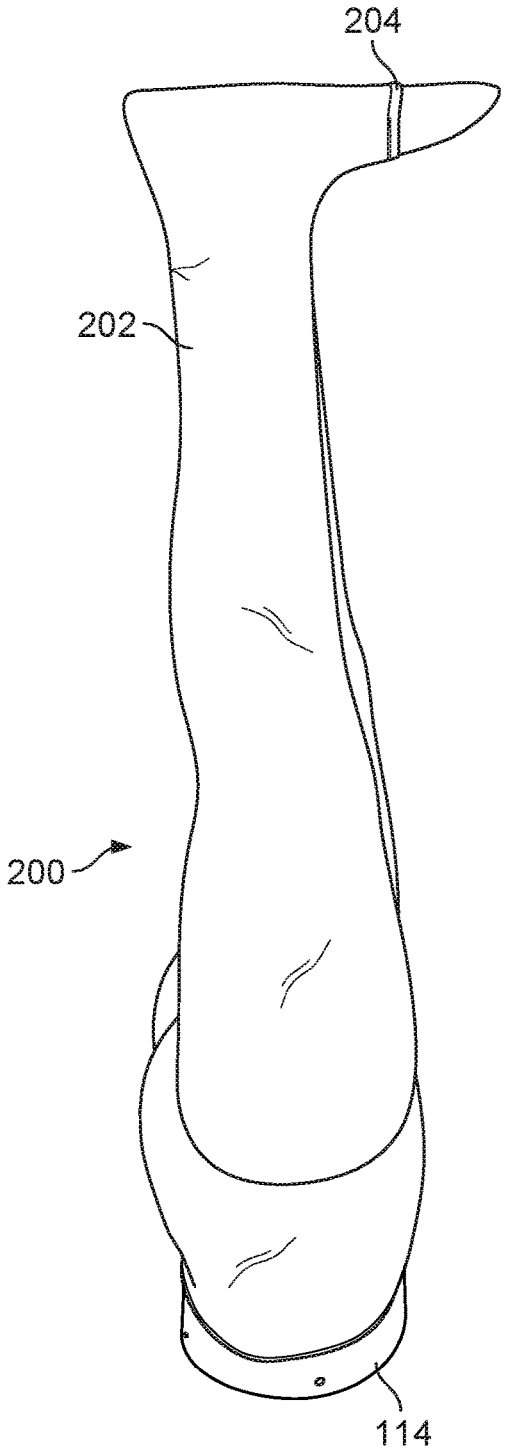
Figure 3D:
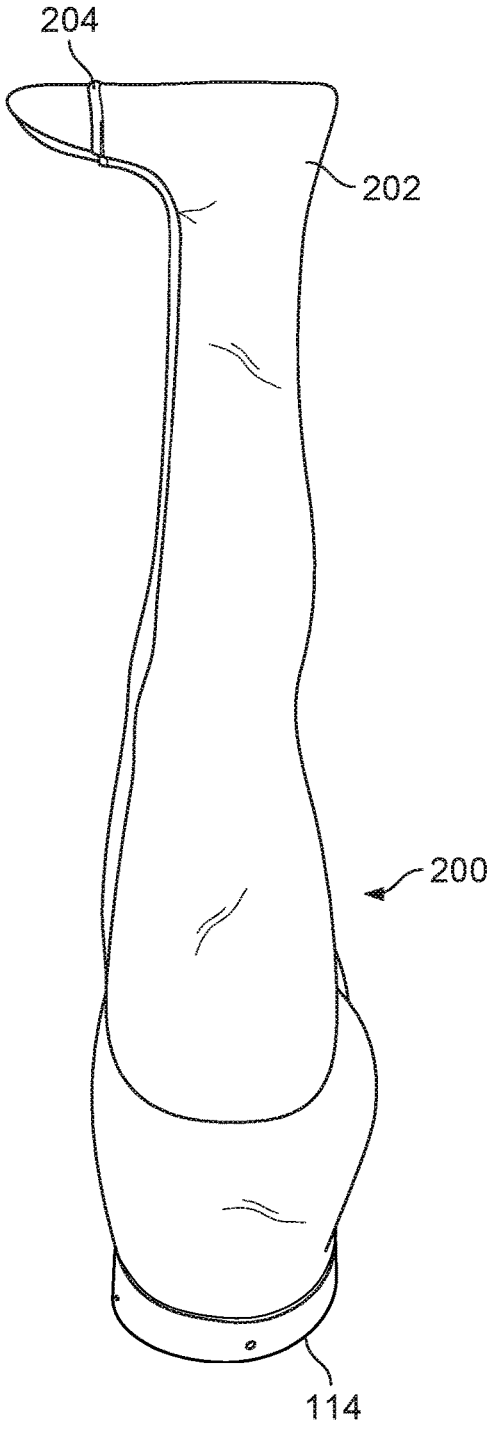
Figure 3E:
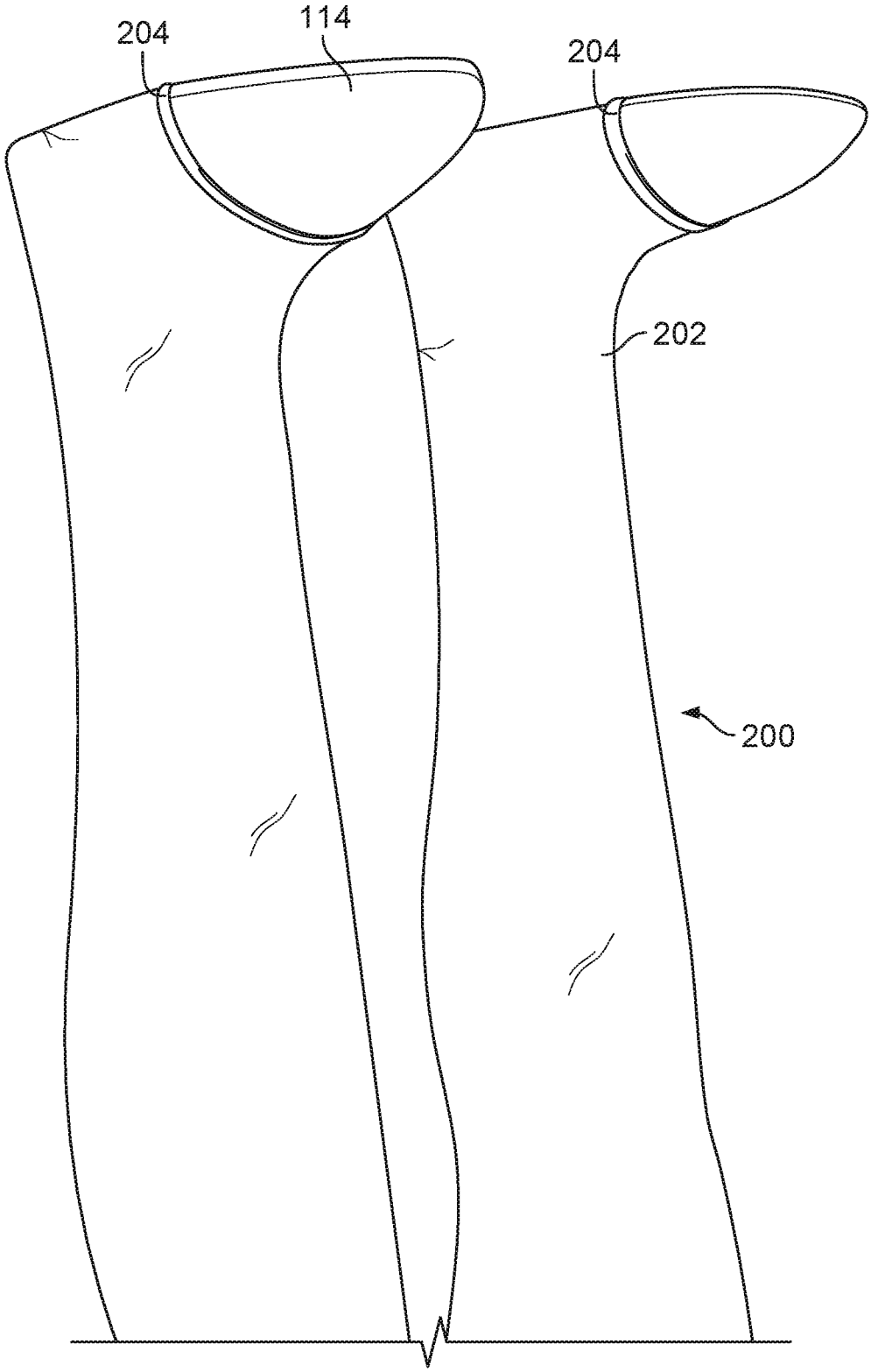

FIGS. 1 and 2 are a partial side view and a partial front view of an example toeless garment 100 positioned on a foot 110 of a wearer. The garment 100 includes a body portion 102 that encircles a portion of a lower leg (e.g., ankle, calf, and/or shins) of the wearer and a portion of the foot 110 (e.g., heel, arch, and/or other portion) of the wearer. The body portion 102 is shown as a generally cylindrical piece of fabric encircling the wearer's leg. FIGS. 1 and 2 show the body portion 102 as covering the lower leg, heel, and foot arch of the wearer, but the body portion 102 can cover additional or fewer body portions of the wearer. The garment 100 also includes a welt portion 104 adjacent an end of the body portion 102. The welt portion 104 can be a cylindrical, ring-shaped welt attached at the end of the body portion 102. The welt portion 104 attaches to the end of the body portion 102, and can connect to the body portion 102 in a variety of ways. For example, the welt portion 104 can be knit (e.g., seamlessly) to the body portion 102, sewn or stitched to the body portion 102, adhered or welded to the body portion 102, or otherwise connected to the end of the body portion 102.

The welt portion 104 encircles a portion of the foot 110, and defines an opening 106 through which an end of the foot 110, including the toes 112, extend through. The welt portion 104 acts as a toe cuff of the garment 100, and in some instances, includes a turned welt. FIGS. 1 and 2 show the welt portion 104 of the example garment 100 as including a turned welt, but the type of welt can be different. The turned welt forms a double-layer welt with a folded edge on an outermost end of the turned welt. An inner end of the turned welt can be knit, seamlessly knit, stitched, seamed, adhered, or otherwise connected to the body portion.

The opening 106 defined by the welt portion 104 allows an end portion of the foot 110, including the toes 112, to extend through the welt portion 104 such that the welt portion encircles a portion of the foot 110 at the opening 106. The welt portion 104 is shown in FIGS. 1 and 2 as encircling the ball of the foot 110. However, the position of the welt portion 104 on the foot 110 can vary. For example, the welt portion 104 can encircle the foot 110 at the arch of the foot, the ball of the foot, or elsewhere between the toes 112 and the heel.

The welt portion 104 and the body portion 102 can include, or be made up of, a variety of yarns. For example, the body portion 102 and/or the welt portion 104 can include nylon and spandex yarns. The yarn thickness and denier can be the same or vary between the body portion 102 and the welt portion 104. For example, the welt portion 104 can include a first yarn that has a first thickness that is greater than a second thickness of a second yarn of the body portion 102. In some examples, the first yarn is about three times the thickness of the second yarn. In certain implementations, the welt portion 104 includes yarns of a larger denier than yarns of the body portion. For example, the first yarn of the welt portion 104 can include a 70 denier yarn, whereas the second yarn of the body portion 102 has a lesser denier. The yarn may include bicomponent fibers, configured in a sheath/core, side-by-side, or eccentric sheath/core arrangement.

The welt portion 104 encircles and compresses against the portion of the foot 110. In some implementations, an initial, unstretched length (e.g., circumference) of the welt portion 104 is less than a circumference of the portion of the foot 110 that the welt portion 104 encircles. The welt portion 104 is stretched to some degree to fit around the portion of the foot 110, and elastic characteristics (e.g., stretchback, elasticity, and/or other) of the welt portion 104 bias the welt portion 104 to compress against the foot 110 of the wearer and stay positioned on the foot 110 of the wearer. In other words, since the elastic characteristics of the welt portion 104 bias the welt portion 104 to return to its original, unstretched length, the welt portion 104 applies a compressive force on the portion of the foot 110 of the wearer, since the portion of the foot 110 of the wearer stretches the welt portion 104 beyond its initial, unstretched length.

The size of the welt portion 104 can vary, for example, in thickness, width (e.g., dimension from the outermost end of the welt portion 104 to the inner end of the welt portion adjacent the body portion 102), and/or length (e.g., circumference). In some examples, the welt portion 104 is about 3-3¾ inches in length or circumference, between ⅛ inch and ½ inch in width (e.g., ⅛ inch, ¼ inch, ½ inch, or other), and/or about 1/16 inch in thickness. However, these dimensions can vary. In some implementations, the welt portion 104 (e.g., turned welt) has an elongation of at least 115%, where percent elongation is equal to $(L_1-L_0)/L_0$, where $L_0$ is an unstretched length and $L_1$ is a stretched length. For example, for an example welt portion having a length (e.g., circumference) of 3¾ inches (L0) and a stretched length of 8 inches (L1), the example welt portion has a percent elongation of about 115%.

The elastic and compressive characteristics of the welt portion 104 allow the welt portion 104 to position itself on the foot 110 and maintain that position on the foot 110, for example, during activity and movement of the wearer. The welt portion 104 of FIGS. 1 and 2 exclude silicone embedded, adhered, or otherwise connected to the welt portion 104. Excluding silicone or other polymers from the welt portion 104 improves comfort for the wearer, for example, as silicone and other polymers can be a skin irritant. Additionally, manufacturing (e.g., knitting) the welt portion 104 without silicone reduces manufacturing costs. However, in some instances, the welt portion 104 can include silicone (e.g., silicone band, silicone lines and/or other silicone application) and/or another polymer on an inner surface of the welt portion 104 to engage with (e.g., adhere to) the foot 110 of the wearer.

The welt portion 104 of FIGS. 1 and 2 excludes toe loops or bar tacks. Excluding toe loops or bar tacks improves comfort for the wearer, for example, as toe loops and bar tacks can irritate the skin between toes of the wearer and be a cause of discomfort. Also, excluding tope loops or bar tacks allows the welt portion 104 to be freely positioned at any point on the foot 110 of the wearer, whereas toe loops and bar tacks often allow only one position of a toe cuff on the foot of a wearer. However, in some instances, the welt portion 104 can include one or more toe loops and/or one or more bar tacks configured to be positioned between adjacent toes of the wearer.

The garment 100 can be implemented in a number of different garment types. For example, the garment 100 can include hosiery (e.g., sheer hosiery), tights, stockings, pants, long underwear, and/or other garment types. For example, FIGS. 3A-3E are front, perspective, left side, right side, and close-up perspective views, respectively, of an example toeless garment 200 on a wearer 114 (shown in FIGS. 3A-3E as a mannequin). The garment 200 of FIGS. 3A-3E is like the garment 100 of FIGS. 1 and 2, except the garment 200 is sheer hosiery, or sheer tights. The garment 200 includes a body portion 202 and welt portion 204 like the body portion 102 and welt portion 104 of FIGS. 1 and 2.

Figure 4:
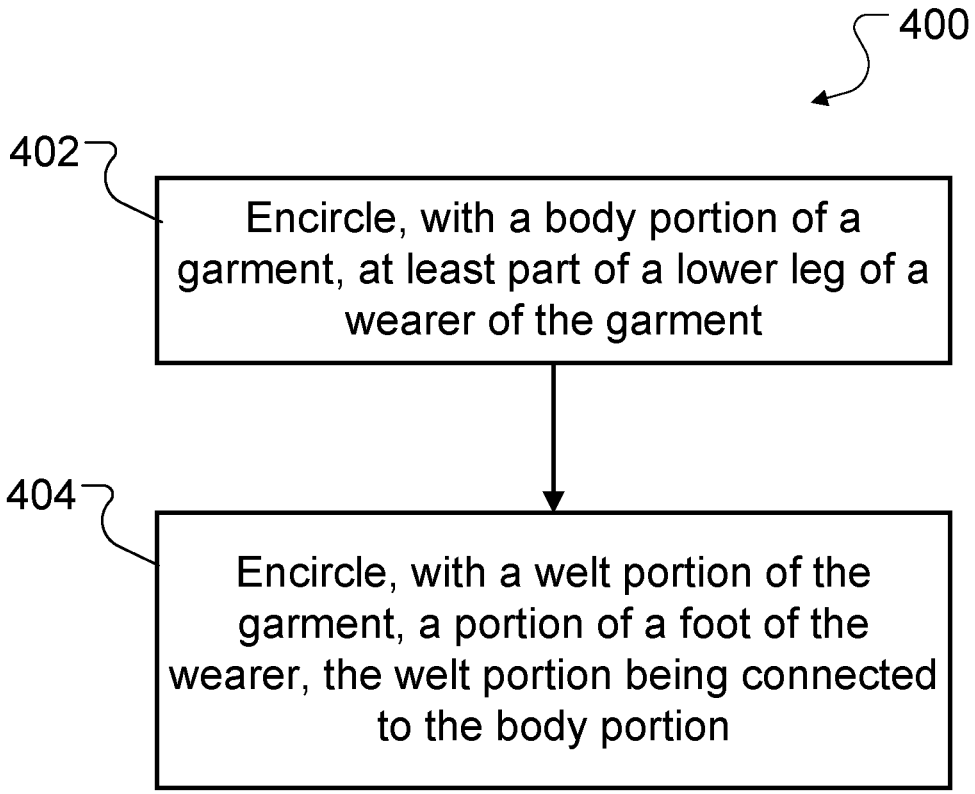
FIG. 4 is a flowchart of an example method for encircling a foot of a wearer with a toeless garment.

FIG. 4 is a flowchart describing an example method 400, for example, for encircling a portion of a foot of a wearer. The example method 400 can be performed by the example garments 100 and 200, described above. At 402, a body portion of a garment encircles at least part of a lower leg of a wearer of the garment. At 404, a welt portion of the garment encircles a portion of a foot of the wearer, the welt portion being connected to the body portion. In some instances, the welt portion is a turned welt, and encircles an arch area of the foot and/or a ball of the foot of the wearer. In certain instances, the welt portion directly contacts the portion of the foot of the wearer, for example, without the presence of silicone or other polymer. Encircling the portion of the foot with the welt portion can include compressing the portion of the foot with the welt portion.

A number of implementations have been described. Nevertheless, it will be understood that various modifications may be made without departing from the spirit and scope of the disclosure.

What is claimed is:

1. A garment comprising:

a body portion configured to encircle at least part of a lower leg of a wearer of the garment; and a welt portion adjacent an end of the body portion and configured to encircle and directly contact a foot of the wearer, the welt portion comprising a turned welt that forms a double-layer welt with a folded edge on an outermost end of the turned welt, the turned welt having a continuous cylindrical ring shape and defining an opening, the welt portion having an elongation of at least 115% and the welt portion configured to compress a portion of the foot of the wearer when stretched beyond an initial, unstretched length of the welt portion;

the welt portion comprising a first yarn having a first thickness and the body portion comprising a second yarn having a second thickness, and the first thickness of the first yarn is about three times the second thickness of the second yarn.

2. The garment of claim 1, wherein the welt portion is configured to encircle the foot at an arch of the foot.

3. The garment of claim 1, wherein the welt portion comprises a silicone band attached to or integral to the welt portion.

4. The garment of claim 1, wherein the welt portion is free from silicone.

5. The garment of claim 1, wherein the welt portion comprises nylon and spandex yarns.

6. The garment of claim 1, wherein the welt portion is seamlessly knit to the body portion.

7. The garment of claim 1, wherein the welt portion is sewn to the body portion.

8. The garment of claim 1 wherein the first yarn comprises a 70 denier yarn.

9. The garment of claim 1, wherein the garment comprises tights, stockings, hosiery, pants, or long underwear.

10. The garment of claim 9, wherein the garment comprises sheer hosiery.

11. The garment of claim 1, wherein the turned welt comprises a width dimension from a first longitudinal end of the turned welt to a second, opposite longitudinal end of the turned welt, the width dimension being between ⅛ inch and ½ inch.

12. A method, comprising:

encircling, with a body portion of a garment, at least part of a lower leg of a wearer of the garment; and encircling and directly contacting, with a welt portion of the garment, a portion of a foot of the wearer, the welt portion being connected to the body portion and comprising a turned welt that forms a double-layer welt with a folded edge on an outermost end of the turned welt, the turned welt having a continuous cylindrical ring shape, the welt portion having an elongation of at least 115%, wherein encircling the portion of the foot comprises compressing the portion of the foot of the wearer with the welt portion when the welt portion is stretched beyond an initial, unstretched length;

wherein the welt portion comprises a first yarn having a first thickness and the body portion comprises a second yarn having a second thickness, and the first thickness of the first yarn is about three times the second thickness of the second yarn.

13. The method of claim 12, wherein encircling a portion of a foot of the wearer comprises encircling, with the welt portion, an arch area of the foot of the wearer.

14. The method of claim 12, wherein the welt portion is free from silicone, and the foot of the wearer does not contact silicone proximate to the welt portion.

15. The method of claim 12, wherein the portion of the foot is a first portion of the foot, and the method comprising moving the welt portion along the foot to a second portion of the foot different from the first portion of the foot.

16. The method of claim 12, wherein the turned welt comprises a width dimension from a first longitudinal end of the turned welt to a second, opposite longitudinal end of the turned welt, the width dimension being between ⅛ inch and ½ inch.

* * * * *